US007878338B2

(12) United States Patent
Maxson

(10) Patent No.: US 7,878,338 B2
(45) Date of Patent: Feb. 1, 2011

(54) TRANSPORT AND STORAGE CONTAINER FOR SCAFFOLD FRAMES AND BRACES

(76) Inventor: Don F. Maxson, 885 275$^{th}$ St., West Branch, IA (US) 52358

( * ) Notice: Subject to any disclaimer, the term of this patent is extended or adjusted under 35 U.S.C. 154(b) by 672 days.

(21) Appl. No.: 11/894,116

(22) Filed: Aug. 20, 2007

(65) Prior Publication Data

US 2008/0105492 A1 May 8, 2008

Related U.S. Application Data

(60) Provisional application No. 60/857,380, filed on Nov. 7, 2006.

(51) Int. Cl.
*A47G 19/08* (2006.01)

(52) U.S. Cl. ..... 211/41.15

(58) Field of Classification Search ..... 211/189, 211/41.15, 49.1, 27, 41.14, 186, 191; 414/607, 414/608; 182/141, 151, 145, 129; 108/51.11; 220/1.5; 312/249.8
See application file for complete search history.

(56) References Cited

U.S. PATENT DOCUMENTS

| | | | | |
|---|---|---|---|---|
| 3,217,449 | A | 11/1965 | Levere | |
| 3,351,207 | A | 11/1967 | Meek | |
| 4,901,650 | A | 2/1990 | Armstead | |
| 4,952,114 | A | 8/1990 | Langer | |
| 5,018,629 | A | 5/1991 | Lamar | |
| 5,433,322 | A | 7/1995 | Williams | |
| 5,579,866 | A * | 12/1996 | Rowell | 182/150 |
| 5,617,931 | A | 4/1997 | Zygmun et al. | |
| 5,860,627 | A | 1/1999 | Edwards | |
| 5,938,064 | A | 8/1999 | Smith, Jr. | |
| 6,109,390 | A | 8/2000 | Giannopoulos | |
| 6,182,791 | B1 | 2/2001 | Cope | |
| 6,279,763 | B1 * | 8/2001 | Bush | 211/195 |
| 6,290,023 | B1 * | 9/2001 | Martin | 182/127 |
| 6,431,314 | B1 | 8/2002 | Boulanger et al. | |
| 6,494,292 | B2 | 12/2002 | Cope | |
| 6,820,752 | B2 * | 11/2004 | Jeskey et al. | 211/41.14 |

(Continued)

FOREIGN PATENT DOCUMENTS

DE 4313182 A1 * 10/1994

(Continued)

*Primary Examiner*—Darnell M Jayne
*Assistant Examiner*—Patrick Hawn
(74) *Attorney, Agent, or Firm*—Allan L. Harms; Shuttleworth & Ingersoll, PLC

(57) ABSTRACT

An OSHA compliant container for scaffold frames and cross braces includes a floor bordered by recessed channels into which legs of scaffold frames may be placed. A central upright frame includes rest surfaces against which the upper ends of the first scaffold frame placed into the container may rest. A stop element in each channel prevents the lower ends of the scaffold legs from being placed against the upright frame. Upright posts at the corners of the base of the container support side rails which provide fall protection for a worker inside the container. Lanyard rings attached to the upright posts provide connection points for safety harness and for a gate to provide additional fall protection for a worker within the container. Underlying fork tubes extending longitudinally as well as transversely allow the container to be lifted by a fork lift from either end and either side.

15 Claims, 8 Drawing Sheets

U.S. PATENT DOCUMENTS

| | | | | |
|---|---|---|---|---|
| 6,880,672 | B2 | 4/2005 | Imberi | |
| 6,955,384 | B1 * | 10/2005 | Good | 296/3 |
| 7,104,429 | B1 * | 9/2006 | Flores | 224/405 |
| 7,214,025 | B2 | 5/2007 | Rudolph | |
| 2001/0045718 | A1 | 11/2001 | Boirum | |
| 2003/0221907 | A1 | 12/2003 | Bennett | |
| 2005/0039984 | A1 | 2/2005 | Nickel | |

FOREIGN PATENT DOCUMENTS

| | | | |
|---|---|---|---|
| DE | 29613272 | U1 * | 9/1996 |
| FR | 2880870 | A1 * | 7/2006 |

* cited by examiner

TRANSPORT AND STORAGE CONTAINER FOR SCAFFOLD FRAMES AND BRACES

CROSS-REFERENCE TO RELATED APPLICATIONS

This application claims priority from provisional patent application entitled "Transport and Storage Container for Scaffolding Frames and Braces," Ser. No. 60/857,380 filed Nov. 7, 2006. The disclosure of provisional patent application Ser. No. 60/857,380 is hereby incorporated in its entirety.

FIELD OF THE INVENTION

The present invention pertains to storage and transport containers for scaffold frames and cross braces.

BACKGROUND OF THE INVENTION

In the construction of buildings, scaffolding is used to provide elevated work places for the workers participating in construction and particularly for workers laying bricks or blocks or installing siding on the exteriors of buildings being constructed or repaired. Scaffolding structures consist of scaffold frames (sometimes termed "trestle frames" and which include ladder frames and walk through frames), cross braces which create bracing between pairs of scaffold frames, and locking pins and other hardware used in assembly of scaffolding. Scaffolding is assembled by manual means, with workers moving the scaffold frames into place and installing cross braces between opposing frames. The scaffold frames, cross braces and assembly hardware must be moved into position for assembly and then removed after use. Then the scaffold elements must be stored or moved to the next worksite as needed.

Customary handling of scaffold members entails stacking scaffold frames on a trailer and then tying the frames to the trailer so they may be transported. When the scaffold frames are to be used, they must be lifted off the trailer, placed in an upright orientation and carried to the location where needed.

Past efforts to store scaffold frames have included devices shown in U.S. Pat. Nos. 4,952,114 and 5,018,629. In U.S. Pat. No. 4,952,114, a container for scaffold frames requires that the scaffold frames be carefully placed upright within bracket elements, resulting in spaces between adjoining frames. In the case of the device described in U.S. Pat. No. 5,018,629, the scaffold frames must be placed in horizontal orientation and inserted into the container. When scaffolding is to be assembled, the scaffold frames must be lifted from the container and raised to an upright position before they are carried to the site for assembly.

No scaffolding container is known which allows a worker to be elevated safely along with stored scaffold frames and cross braces to the assembly level where the scaffold members are needed.

BRIEF SUMMARY OF THE INVENTION

This invention provides a convenient container for scaffold frames, cross brace members and locking pins. The invention comprises a base including a floor on which a worker may walk or stand, bordered by recessed channels into which the lower ends of scaffold frame members may be placed. Standing generally centered between the opposing ends of the base is an upright central frame which includes rest plates against which the upper ends of upright scaffold frame members may lean. The upright central frame is sufficiently tall to exceed the height of any scaffold frame member to be stored in the container.

Upstanding at the corners of the base are upright posts which, with the upright frame, support lateral side rails which are positioned at heights above the base to prevent a worker standing on the floor from falling from the side of the container. The corner upright posts extend to a height such that cradle brackets mounted to the outer sides of the corner uprights and to the upright frame are available to cradle cross brace members therein in a lateral orientation, at a comfortable height for easy removal and placement.

The base includes forklift fork tubes oriented longitudinally as well as transversely under the base so that a fork equipped lifting machine can lift the container from either the sides or the ends.

Each corner upright post is provided with a D-ring securely mounted thereto by welding to provide a securing point on the upright for attachment of a safety line of a worker's safety harness. The height of these D-rings is selected so that a worker may safely and conveniently attach a strap hook to the D-ring. In addition, a cable, strap, or chain may be suspended between the corner uprights to provide a safety barrier when a worker is within the container while it is being moved.

Additional securing loops are fixed to the upper safety rail to provide attachment points for straps used to retain scaffold frames against the upright central frame.

The base is also equipped with rings on the ends and sides which may be used to secure the container to the forklift apparatus when the apparatus is lifted. Sufficient robustness is provided for the rings on the ends of the base to permit the invention to be hoisted by a crane.

Pedestal feet are provided below each corner of the base so that the base of the container is prevented from resting on the ground surface on which it is supported. Plate elements fixed to the bottom of the feet expand the ground-bearing surface of each of the feet.

Drain openings are located in the side channels which receive the legs of the scaffold frames to permit drainage of water from the scaffold frames when the scaffold frames are placed in the container. Spray washing of the scaffold frames is also possible while the scaffold frames are stored in the container because runoff water may exit through the drain openings.

Safety kick plates are located along the longitudinal sides of the floor to prevent a worker from accidentally stepping into one of the side channels which have bottoms below the level of the floor.

All features of the container have been designed with the intention that the container will be fully compliant with the Occupational Safety and Health Act of the United States, as such law presently exists.

Objects of the invention include: providing a container for efficient storage and transport of scaffold frames and brace members; providing a container for scaffold frames and brace members which allows a worker to be safely carried within the container while the container is loaded with scaffold frames and when it is lifted into position for assembly of scaffolding; providing a safe environment from which workers may remove scaffolding at the location where the scaffold frames and cross braces are needed; providing a container for scaffold members which may be lifted safely to the elevation at which scaffolding is being disassembled; providing a scaffold frame container which can be lifted by a forklift machine from either side thereof or either end thereof; providing a safe scaffold transport container which reduces the labor cost for installation and removal of scaffolding. These and other objects of the invention will be understood from examination of the drawings and detailed description which follow.

BRIEF DESCRIPTION OF THE SEVERAL VIEWS OF THE DRAWING(S)

DETAILED DESCRIPTION OF THE INVENTION

Figure 1:
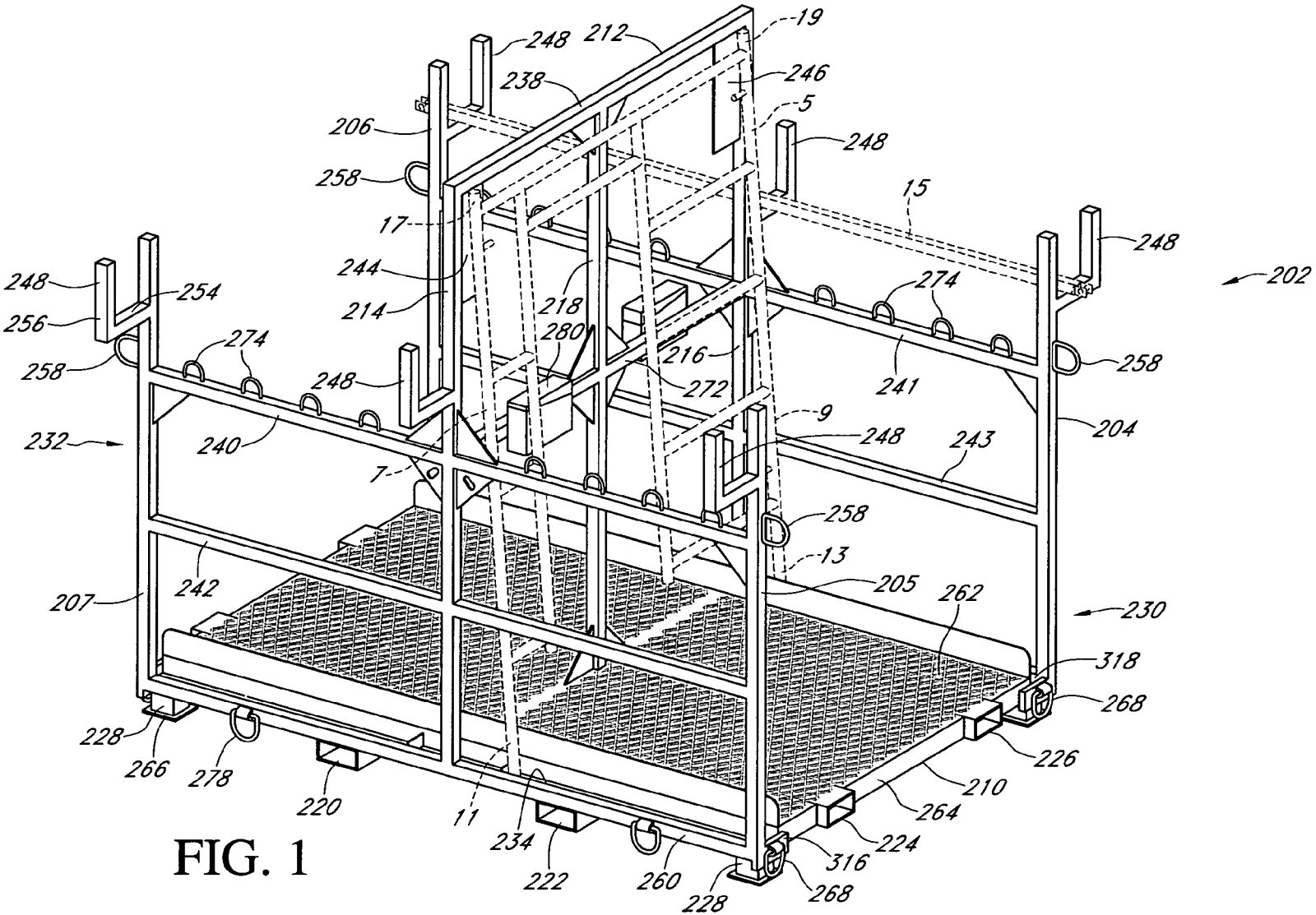
FIG. 1 is a perspective of the preferred embodiment of the invention containing a scaffold frame and a cross brace member shown by dashed lines.

Referring to FIGS. 1 through 4 and initially to FIG. 1, the invention 202 is seen to be a container or rack for scaffold members and is shown with a scaffold frame 5 therewithin resting against the upright central frame 212 of the invention 202. The upper ends 17 and 19 of scaffold frame 5 abut rest plates 244 and 246 of upright frame 212. Upright frame 212 provides a backstop against which the upper ends 17 and 19 of legs 7 and 9 of scaffold frame 5 may lean. Upright frame 212 is preferably mounted to base 210 approximately midway therealong. Rectangular base 210 is supported on corner feet 228 which keep base 210 elevated above the ground surface.

Base 210 further comprises transverse fork tubes 220 and 222 spaced apart suitably (approximately 33.5 inches on center) to receive the forks of a forklift apparatus. Base 210 also comprises longitudinal fork tubes 224 and 226 to receive forks of a forklift apparatus. Base 210 is also provided with floor 262 upon which workers may walk to enter invention 202 to remove scaffold frames 5. Floor 262 preferably is a grating through which dirt and other debris may pass and is supported on transverse brace members as well as transverse beams 264.

Figure 2:
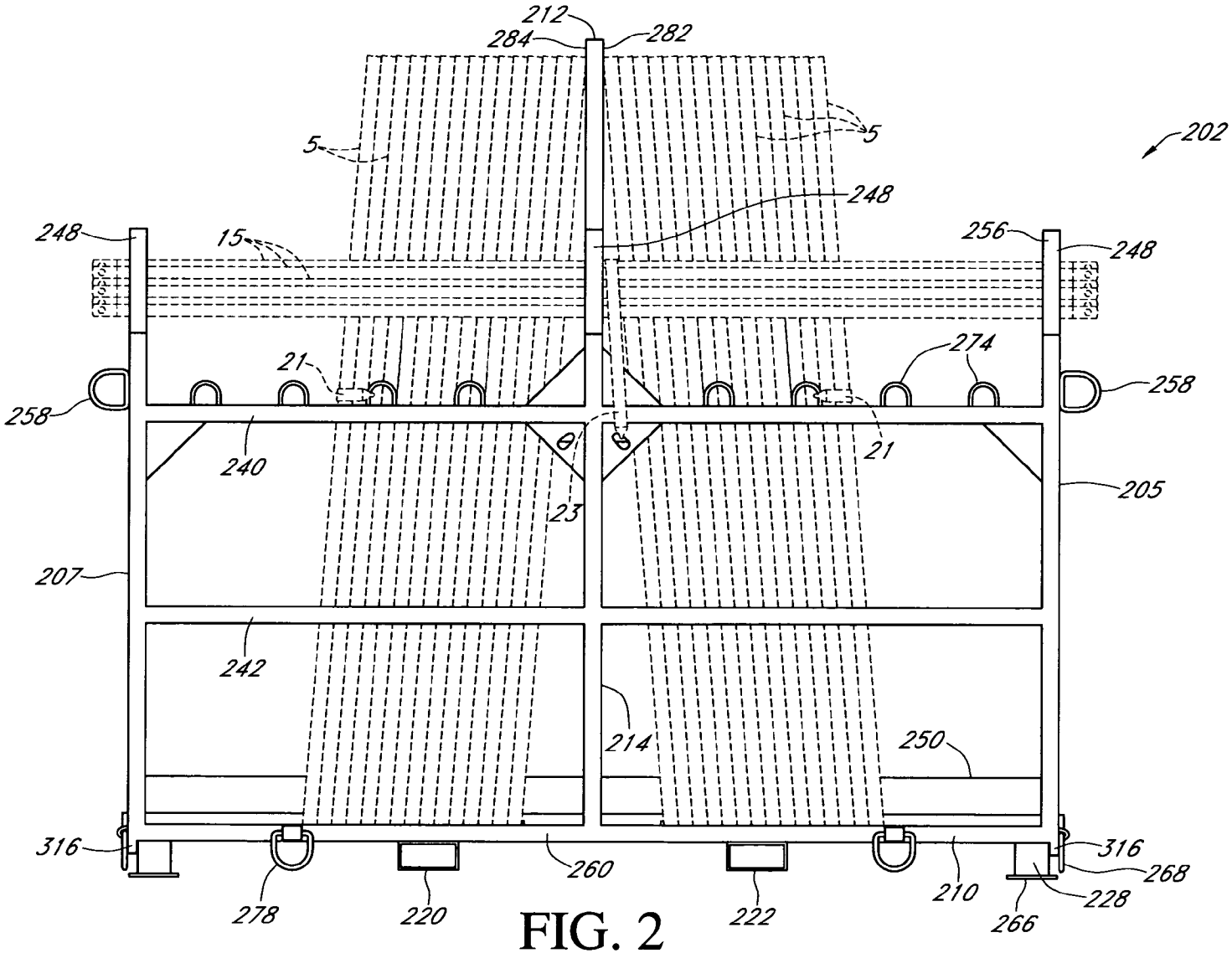
FIG. 2 is a side plan view of the preferred embodiment shown with scaffold frames and braces stored therein, the scaffold frames and cross braces shown by dashed lines.

In FIG. 2, a plurality of scaffold frames 5 are shown leaning against upright frame 212 with a strap 21 attached to a loop 274 on each upper rail 240, 241 on each side of upright frame 212 to retain scaffold frames 5 to the upright frame 212.

A plurality of scaffold cross braces 15 are supported by cradle brackets 248 and are held down by strap element 23.

Figure 3:
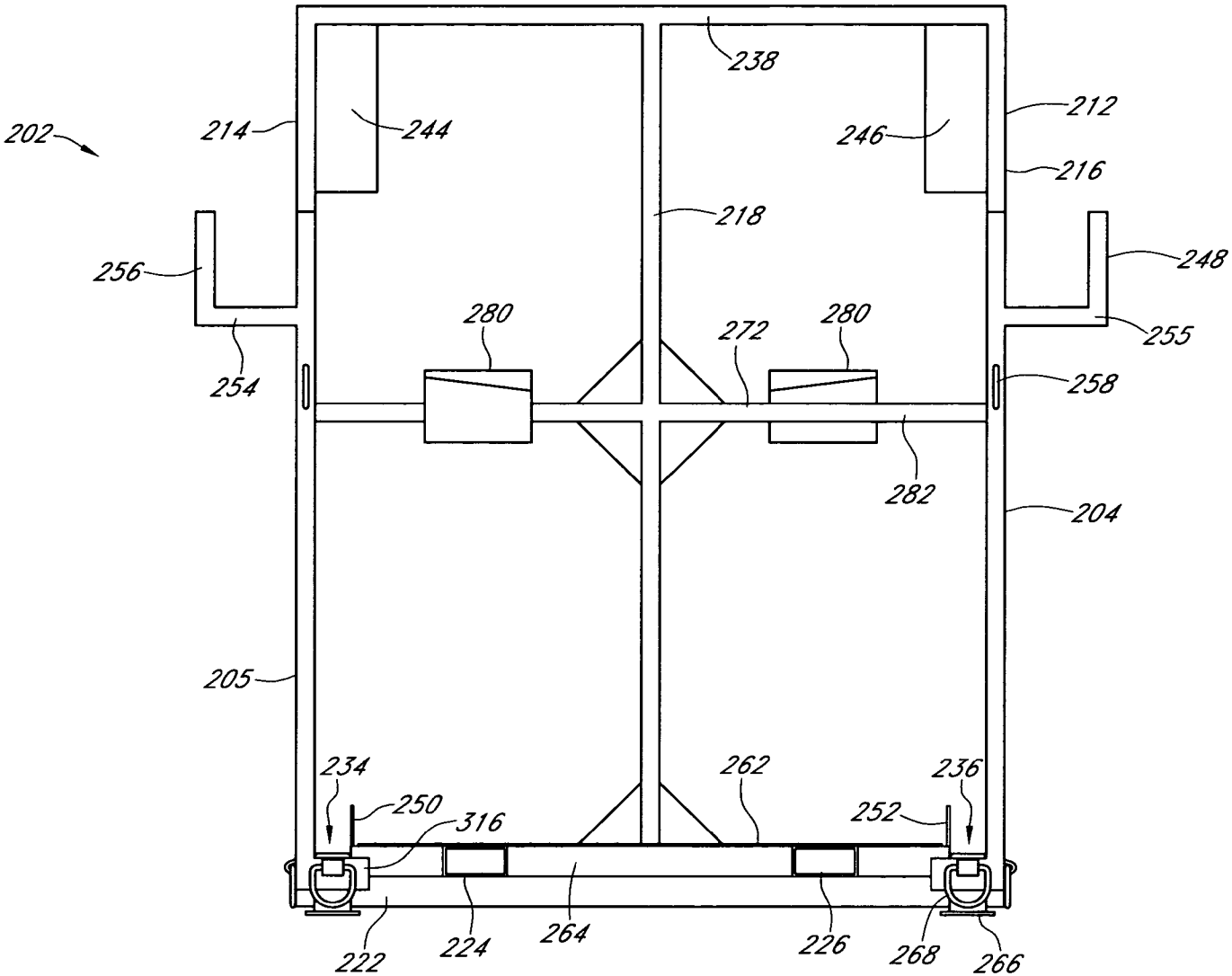
FIG. 3 is a front elevation of the preferred embodiment.
Figure 4:
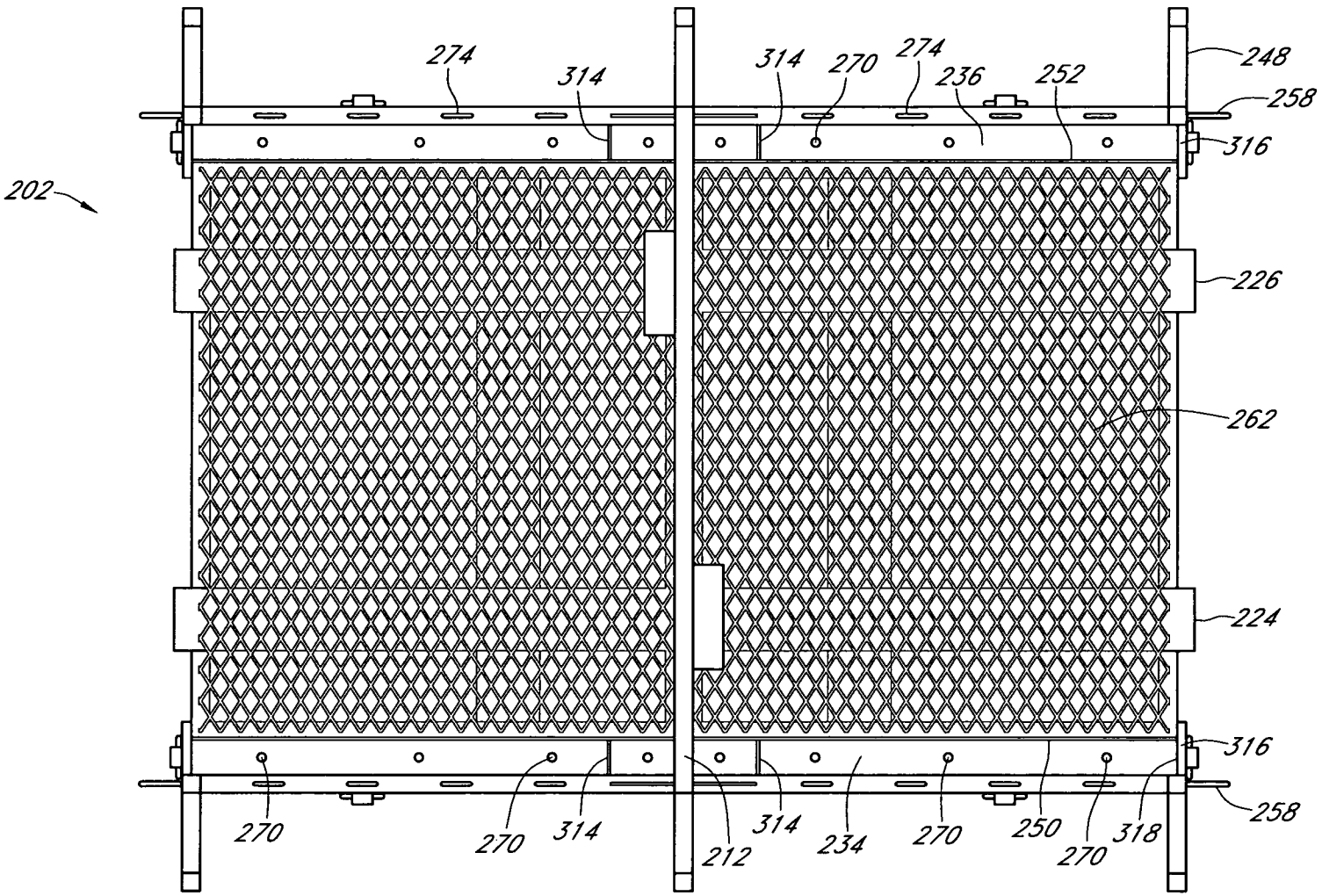
FIG. 4 is a top plan view of the preferred embodiment.

Referring now additionally to FIGS. 2 through 4, it may be seen that upright posts 204, 205, 206, 207 stand at the four corners of base 210 and each supports a cradle bracket 248 at its upper end.

Located midway along base 210 is upright frame 212. Upright frame 212 comprises a first upright bar 214, opposing second upright bar 216 and medial upright bar 218, all joined by top cross bar 238 and intermediate cross bar 272. Medial upright post 218 also joins top bar 238 to base 210. Parts boxes 280 are mounted to intermediate cross bar 272 with one parts box 280 mounted to intermediate cross bar 272 generally midway between first upright bar 214 and medial upright bar 218 on first side 282 of upright frame 212 while a second parts box 280 is mounted to intermediate cross bar 272 midway between second upright bar 216 and medial upright bar 218 on second side 284 of upright frame 212.

Upright posts 205 and 207 are joined to first upright bar 214 of upright frame 212 by upper rail 240 and lower rail 242, while upright posts 204 and 206 are joined to second upright bar 216 of upright frame 212 by upper rail 241 and lower rail 243. Rails 240, 241, 242 and 243 provide fall protection for a worker standing on floor 262 of base 210. Specifically upper rails 240 and 241 are at least forty-two inches above the floor 262 of base 210, while lower rails 242 and 243 are located approximately midway between upper rails 240 and 241 and floor 262.

Mounted along and preferably above the upper rails 240, 241 are a series of attachment loops 274 which provide attachment points for conventional securing straps which may be used to retain a leaning stack of scaffold frames 5 against central upright frame 212.

Preferably invention 202 is longitudinally symmetrical around upright frame 212 so that scaffold frames may be loaded into invention 202 from either its first end 230 or its second end 232.

Base 210 further comprises leg receiving channels 234 and 236 which are located outboard of kick plates 250 and 252 and run the longitudinal length of invention 202 from first end 230 thereof to its second end 232. Kick plates 250 and 252 define the edges of floor 262 which is elevated approximately four inches above leg receiving channels 234 and 236. Kick plates 250 and 252 serve to prevent workers on floor 262 from stepping into recessed leg receiving channels 234 and 236 which have bottoms below the level of floor 212.

Base 210 is rectangular, comprising longitudinal beams 260 along its sides and transverse beams 264 along each of ends 230, 232. Transverse beams 264 incorporate longitudinal fork tubes 224 and 226 and join upright posts 204 and 205 at first end 230, and upright posts 206 and 207 at second end 232. Longitudinal beams 260 and transverse beams 264 create a rectangular supporting frame for base 210. Each transverse fork tube 220 and 222 underlies the longitudinal beams 260 and each extends below base 210 for the width of invention 202. Each longitudinal fork tube 224, 226 extends the length of base 210.

Preferably, base 210 is approximately 87.5 inches in length and 68 inches in width. These dimensions permit invention 202 to be carried longitudinally on utility trailers, as well as transversely on semi-trailers. The orthogonal arrangement of longitudinal fork tubes 224, 226 and transverse fork tubes 220, 222 allows invention 202 to be lifted by forklift apparatus from either end or either side thereof.

Floor 262 is supported upon longitudinal fork tubes 224 and 226, and also upon a series of spaced apart transverse floor braces (not shown) which are welded in abutment between longitudinal fork tubes 224, 226 and between fork tubes 224, 226 and longitudinal side rails 260. Kick plates 250 and 252 are upstanding linear edged plates edging floor 262 and separating floor 262 from leg receiving channels 234 and 236.

Base 210 is supported by corner feet 228 mounted below each corner of base 210 such that side fork tubes 222 and 224 are elevated a small amount above the ground surface when invention 202 rests on a ground surface. Each foot 228 is provided with a bottom plate 266 which is larger in area than the cross section of foot 228, to provide a bearing surface for foot 228 on the underlying ground or other support surface.

Each parts box 280 is located along intermediate cross bar 272 of upright frame 212 such that scaffold frame 5 will not contact parts box 280 when scaffold frame 5 is placed in invention 202. Each parts box 280 may be used to contain small scaffold assembly parts such as interconnection pins.

It should be understood that spaces between upright posts 204, 205 and upright posts 206, 207 provide portals through which a worker may move a scaffold frame 5 from either end 230 and 232 of invention 202. Invention 202 is symmetrical about its central upright frame 212.

Paired lift rings 268 are securely fixed by welding to each transverse beam 264 of base 210 of invention 202 such that invention 202 may be lifted by a crane. Lift rings 268 also may be used to secure invention 202 to a fork lifting apparatus when the forks thereof are inserted into longitudinal fork tubes 224, 226.

Securing rings 278 are fixed along longitudinal side beams 260 to provide tie points for securing invention 202 to a fork lift apparatus.

Lanyard rings 258 are provided at a satisfactory height along each of uprights 204, 205, 206, 207, to provide connection points to which a worker may secure his/her safety harness while working around the invention 202 so that the worker may move in a limited range within and outside invention 202 as scaffold frames 5 are removed and assembled. Lanyard rings 258 also provide connection points so that a chain or cable may interconnect uprights 204, 205 and uprights 206, 207 to provide a safety gate when invention 202 is moved about with a worker present therein.

Each of upright posts 204, 205, 206, 207 includes an L-shaped cradle bracket 248 having a first horizontal leg 254 fixed to the upright post 204, 205, 206, 207 and a vertical member 256 joined to the horizontal leg 254 at its free end 255. Cradle brackets 248 cooperate with the upright posts 204, 205, 206, 207 to which mounted, to provide a cradle to carry scaffold cross brace members 15. In addition, each of upright bars 214, 216 of upright frame 212 includes an L-shaped cradle bracket 248 extending outwardly therefrom, the horizontal legs 254 of which are aligned horizontally with the horizontal legs 254 of the cradle brackets 248 fixed to upright posts 204, 205, 206, 207. Cross brace members 15 may lie horizontally within cradle brackets 248.

Referring now to FIG. 4, as well as to FIG. 1, it may be seen that located within each leg receiving channel 234 and 236 adjacent to and on opposing sides of upright frame 212 are stop elements 314 which prevent the lower ends 11 and 13 of a scaffold frame 5 (See FIG. 1) from abutting upright frame 212, thereby forcing scaffold frame 5 to lean against rest plates 244 and 246 of upright frame 212 which are mounted to upright frame 212 at the junctions of upper cross member 238 and upright bars 214 and 216 thereof.

From examination of FIG. 4, it can be seen that drain openings 270 in leg channels 234 and 236 permit water to exit. Because of the environments in which scaffolding may be placed, the legs of scaffold frames may carry mud and water into invention 202. The scaffold frames 5 may be spray washed while in the invention 202 with debris and water escaping from leg channels 234 and 236 through drain openings 270.

Short upright barrier members 316 are located at outer ends 318 of leg channels 234 and 236 to prevent the lower ends 11 and 13 of scaffold legs 7 and 9 from sliding past outer ends 318 if scaffold frames 5 shift during transport. Barrier members 316 may coincide with one-inch thick steel plates welded to base 210 to provide added structural support for lift rings 268.

Invention 202 may be used to store scaffold frame members placed therewithin from either end 230 and 232. Advantageously with this invention, scaffold frame members are stored in a generally upright orientation with the legs thereof resting in leg receiving channels 234 and 236. Workers may walk upon floor 262 while loading or unloading scaffold frames 5 from invention 202 without undue risk of falling from the sides of invention 202 due to presence of kick plates 250 and 252 and side rail members 240 and 242. In addition a worker using invention 202 will attach his safety harness to one of lanyard rings 258 to provide protection from falling completely from a partially constructed scaffold. Thus fall protection is afforded the worker when invention 202 is in an elevated position.

Longitudinal fork tubes 224 and 226 allow invention 202 to be lifted with either one of opposing ends 230 and 232 accessible such that scaffold frames in one of the ends 230, 232 of invention 202 may be removed. Thereafter, the invention 202 may be lowered to a ground surface, and the fork lift disconnected and applied to the opposing end, so that invention 202 may be elevated into a desired position so scaffold frames in the opposing end may be offloaded.

Locking pins and other small hardware used to assemble scaffolding may be stored in parts boxes 280.

Figure 5:
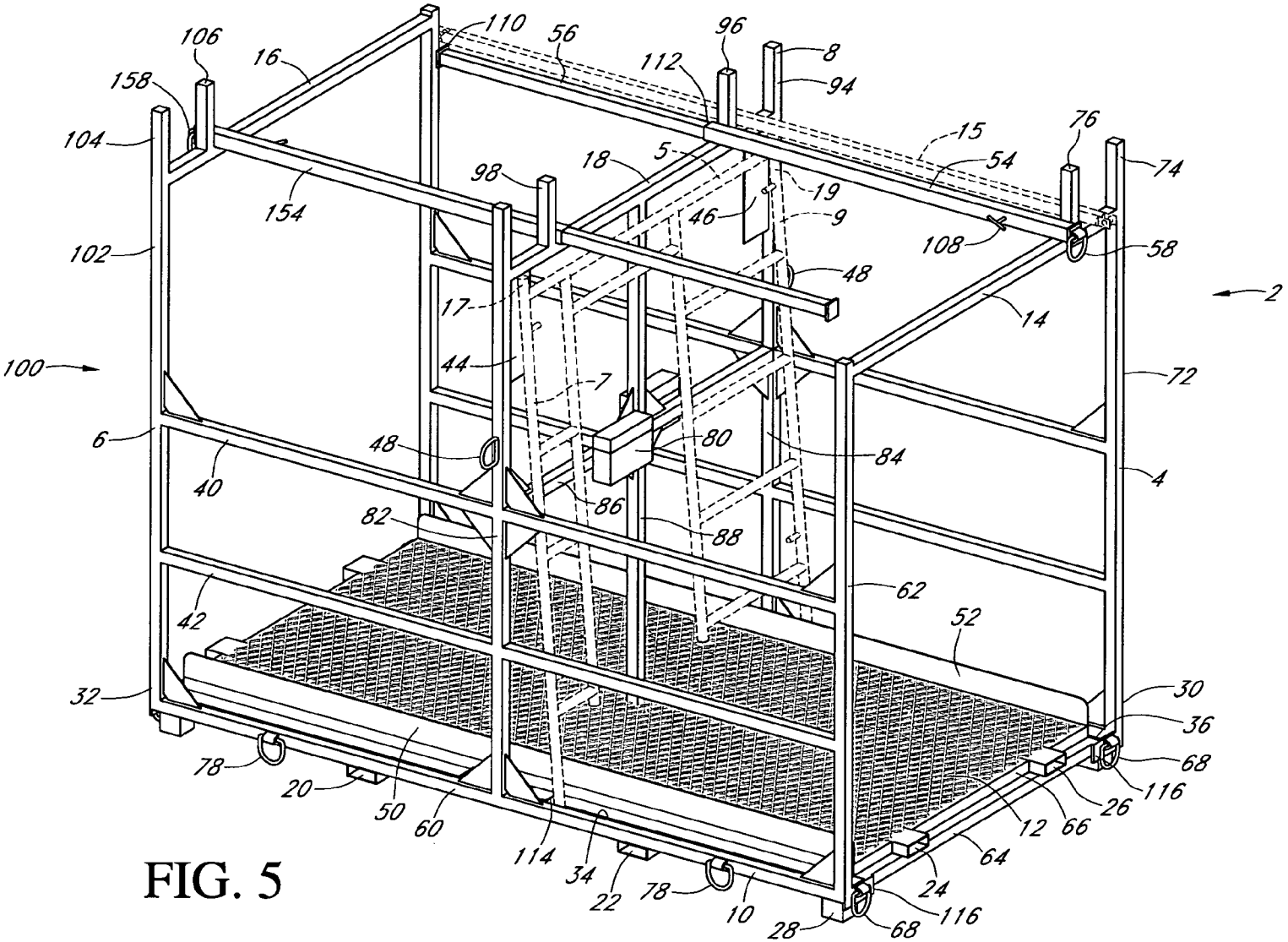
FIG. 5 is a perspective of an alternate embodiment of the invention with one scaffold frame shown by dashed lines stored within the container.
Figure 6:
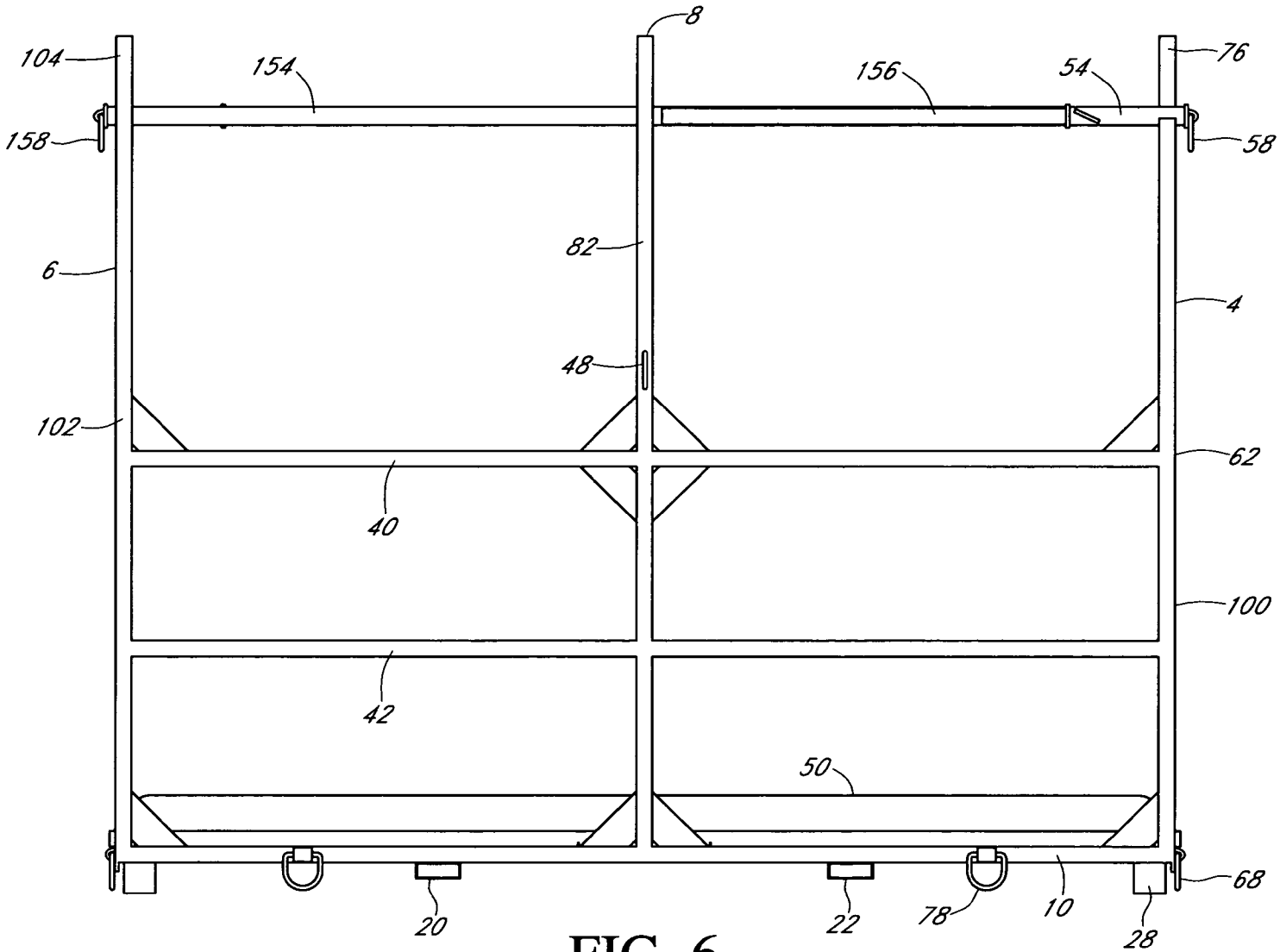
FIG. 6 is a side plan view of the alternate embodiment.
Figure 7:
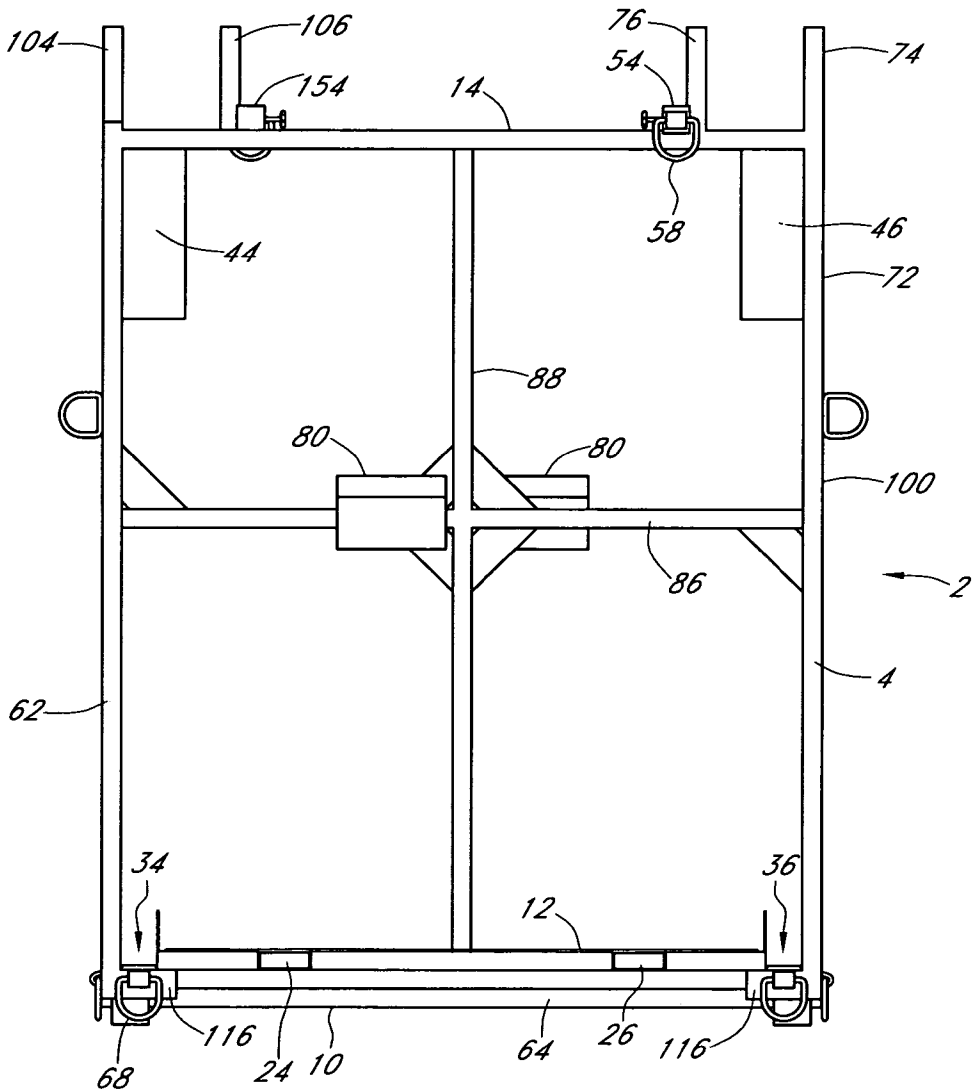
FIG. 7 is a front elevation of the alternate embodiment.

Referring now to FIGS. 5 through 8 and specifically to FIG. 5, the alternate embodiment container 2 is shown with a scaffold frame 5 resting against the central frame member 8 of the container 2. Container 2 comprises a base 10 supported on corner posts 28 which keep base 10 elevated above the ground surface. An open frame 100 is supported upon base 10. Base 10 further comprises transverse fork tubes 20 and 22 spaced apart suitably to receive the forks of a forklift apparatus. Base 10 also comprises longitudinal fork tubes 24 and 26 also spaced apart to receive forks of a forklift apparatus. Base 10 is also provided with floor 12 upon which workers may walk to enter container 2 to remove scaffold frame 5.

It may be seen that open frame 100 also comprises first frame member 4 standing upright upon base 10 at first end 30 of container 2 and second frame member 6 which is mounted at opposing second end 32 of container 2. Spaced generally equidistantly from frame members 4 and 6 is central frame member 8.

Preferably container 2 is symmetrical around central frame member 8 so that scaffold frame 5 may be placed in container 2 from either first end 30 or second end 32 thereof.

Central frame member 8 provides a backstop against which the upper ends 17 and 19 of legs 7 and 9 of scaffold frame 5 may lean. Attachment rings 48 are fixed to opposing sides of central frame member 8 to provide connection points for conventional straps which will be employed to retain scaffold frames 5 to central frame member 8.

Longitudinal side rails 40 and 42 of open frame 100 interconnect frame members 4, 6 and 8. Upper side rail 40 is disposed generally half way up frame 100 while lower side rail 42 is generally equidistant from upper side rail 40 and base 10. Side rails 40 and 42 provide protection to workers within frame 100 from falling therefrom.

Base 10 further comprises leg receiving channels 34 and 36 which are located outboard of kick plates 50 and 52 and run the longitudinal length of container 2 from first end 30 thereof to its second end 32. Kick plates 50 and 52 also run the length of container 2 and define the edges of floor 12 which is elevated a small amount above leg receiving channels 34 and 36. Kick plates 50 and 52 help to prevent workers on floor 12 from stepping into leg receiving channels 34 and 36.

Mounted above and secured to cross member 14 of first frame member 4 and upper cross member 18 of central frame member 8 is first elongate tubular sleeve 54 which slideably receives first safety bar 56. First safety bar 56 may extend a fixed maximum from first elongate tubular sleeve 54 away from first end 30 such that first lanyard ring 58 mounted on first safety bar 56 may be displaced exterior to the space defined by container 2.

Likewise a second elongate tubular sleeve 154 is mounted to and supported by cross member 16 of second frame member 6 and cross member 18 of central frame member 8 so that a worker placing or removing scaffold frames through second end 32 may attach a safety harness lanyard to a second lanyard ring 158.

It is seen that base 10 is rectangular, comprising longitudinal side rails 60 along its sides which are joined at either end to frame members 4 and 6. Each transverse fork tube 22 and 24 depends below the longitudinal side rails 60 and extends below base 10 for the width of container 2.

Lower transverse member 64 of first frame member 4 extends the width of container 2 and is secured to first upright 62 of frame member 4. Supported upon lower transverse member 64 of first frame member 4 and extending longitudinally to second end 32 are longitudinal fork tubes 24 and 26. Floor 12 is supported upon longitudinal fork tubes 24 and 26, and also upon a series of spaced apart transverse floor braces 66 which are welded to longitudinal side rails 60. Kick plates 50 and 52 are upstanding plates edging floor 12 and separating floor 12 from leg receiving channels 34 and 36.

Base 10 is supported by corner posts 28 mounted below each corner of base 10 such that side fork tubes 22 and 24 are elevated a small amount above the ground surface under container 2.

A parts box 80 may be mounted to medial cross brace 86 of central frame member 18 located such that scaffold frame 5 will not contact parts box 80 when scaffold frame 5 is placed in container 2. Parts box 80 may be used to contain small scaffold assembly parts such as securing pins.

It should be understood that each of first and second frame members 4 and 6 provides an open portal through which a worker may move a scaffold frame 5 from either end 30 and 32 of container 2. Second frame member 6 at opposing end 32 of container 2 is identical to first frame member 4. First frame member 4 comprises uprights 62 and 72 upon which cross member 14 is supported. Upright 72 of frame member 4 extends above cross member 14. Spaced away from upper end 74 of second upright 72 is upright bar 76 which stands atop cross member 14.

Central frame member 8 comprises side uprights 82 and 84 which are joined by upper cross member 18 and by medial cross brace 86. Central frame member 8 further comprises central upright 88 which is securely fixed to upper cross member 18 and to medial cross brace 86. Central frame member 8 is sturdily mounted to base 10.

Mounted upon upper cross member 18 are upright bars 96 and 98 spaced apart from the opposing ends of upper cross member 18. The spaces between upright bar 96 and upper end 94 of upright 84 of the central frame member 8 and between upright bar 76 and upper end 74 of upright 72 of first frame member 4 define a region to receive opposing ends of scaffold brace members such as cross brace 15 seen in dashed lines in FIG. 1.

Similarly, upright bar 98 and upper end 94 of upright 84 of central frame member 8 cooperate with the upright 106 upon cross member 16 and upper end 104 of upright 102 of frame member 6 to provide a region to receive ends of scaffold brace members.

Lift rings 68 are located at each corner of container 2 and are securely fixed to base 10 such that container 2 may be lifted by a crane. Lift rings 68 are also available to allow container 2 to be chained to the forks of a forklift machine to prevent container 2 from sliding off such forks.

Securing rings 78 are fixed along longitudinal side rail 60 to provide tie points for securing container 2 to a lifting apparatus.

Extensible safety bars 56 and 156 are slideable within elongate tubular sleeves 54 and 154 respectively but may be secured in any selected position or in a fully retracted position as shown in FIG. 1 by clamp elements 108 which in the preferred embodiments are set screws which may functionally engage the safety bars 56 and 156 to hold each in a selected position along and within elongate tubular sleeves 54 and 154. When container 2 is being transported, it is desirable to prevent safety bars 56 and 156 from sliding along elongate tubular sleeve 54 and 154, and clamp elements 108 prevent that from happening.

When container 2 is in position for a worker to remove scaffold frames 5, clamp element 108 may be manually altered to allow safety bar 56 to extend, for instance, from first end 30 of container 2 so that a worker may secure his safety harness to lanyard ring 58 so that the worker may move about a limited range outside container 2.

An extension stop 110, preferably an obstruction oversized for the interior of elongate tubular sleeve 54 is secured to the inner end 112 of safety bar 56 so that extension of safety bar 56 is limited by abutment of extension stop 110 against inner end 112 of elongate tubular sleeve 54.

Figure 8:
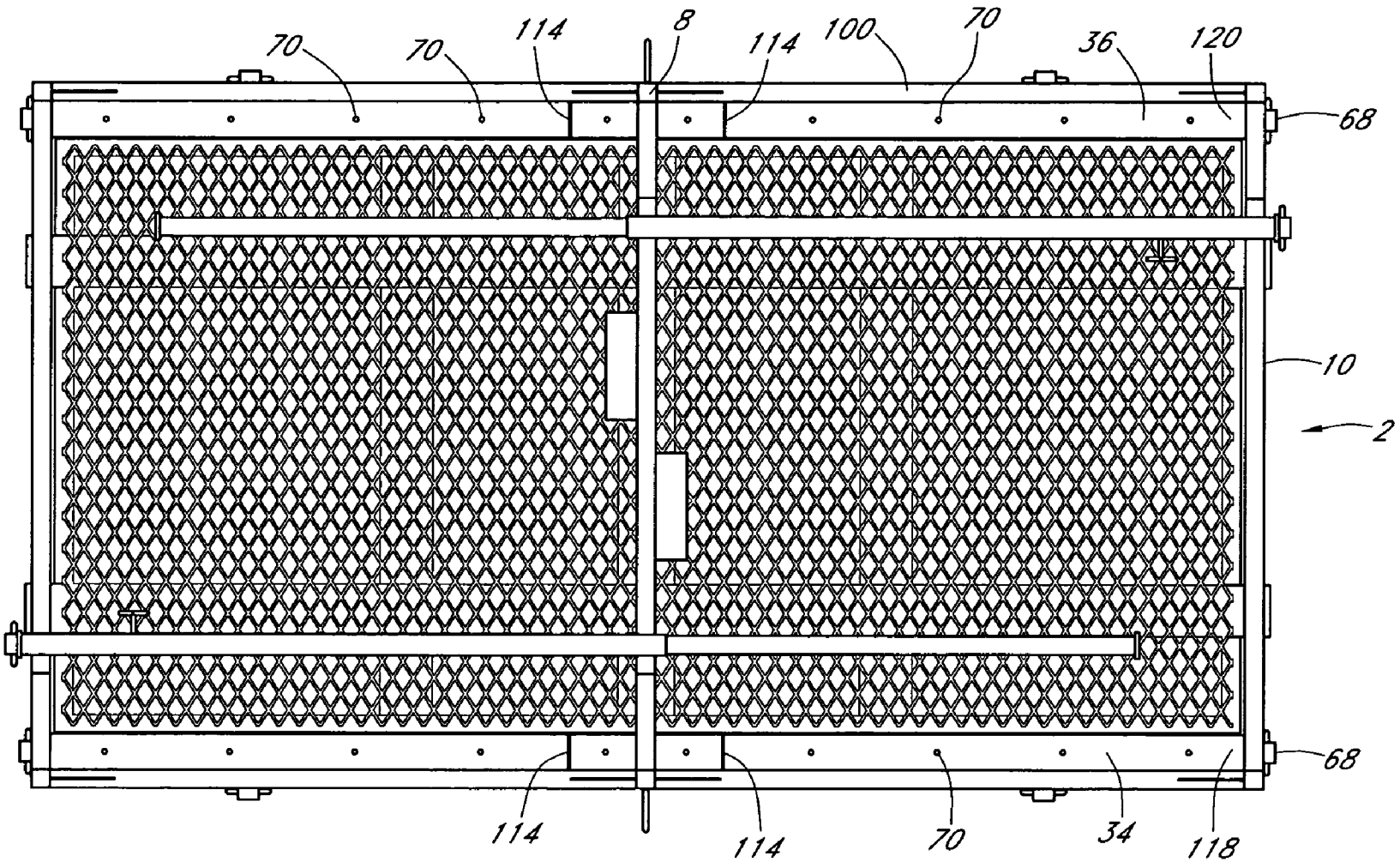
FIG. 8 is a top plan view of the alternate embodiment.

Referring now to FIG. 8, as well as to FIG. 5, it may be seen that located within each leg receiving channel 34 and 36 adjacent to and on opposing sides of central frame member 8 are stop blocks 114 which may prevent the lower ends 11 and 13 of a scaffold frame 5 from abutting central frame member 8, thereby forcing scaffold frame 5 to lean against rest plates 44 and 46 which are fixed to central frame member 8 at the junction of upper cross member 18 and uprights 82 and 84 thereof.

From examination of FIG. 8, it can be seen that drain openings 70 in leg channels 34 and 36 permit water to exit. Because of the environments in which scaffolds may be placed, the legs thereof may carry mud and water into container 2. The scaffold frames 5 may be spray washed while in the container 2 with debris and water escaping from leg channels 34 and 36 through drain openings 70.

Stop members 116 are located at outer ends 118 and 120 of leg channels 34 and 36 to prevent the lower ends 11 and 13 of scaffold legs 7 and 9 from sliding outside frame 100 if scaffold frames 5 shift during transport. Stop members 116 may coincide with one-inch thick steel plates welded to base 10 to provide added structural support for lift rings 68.

Container 2 may be used to store scaffold frame members placed within frame 100 from either end 30 and 32. Advantageously, scaffold frame members are stored in a generally upright orientation with the legs thereof resting in leg receiving channels 34 and 36. Workers may walk upon floor 12 while loading or unloading scaffold frame members from container 2 without undue risk of falling from the sides of frame 100 due to presence of kick plates 50 and 52 and side rail members 40 and 42. In addition a worker using container 2 may attach his safety harness to first lanyard ring 58 and may extend safety bar 56 from elongate tubular sleeve 54 to such point that the extension stop 110 thereof abuts to inner end 112 of elongate tubular sleeve 54. Thus fall protection is afforded the worker when container 2 is in an elevated position and the worker is entering or leaving the container 2.

Longitudinal fork tubes 24 and 26 allow container 2 to be lifted with one of opposing ends 30 and 32 accessible such that scaffold frames in one end of container 2 may be removed. Thereafter, the container 2 may be reversed on the forklift so scaffold frames in the opposing end may be offloaded.

Scaffold cross brace members may be stored atop frame 100 extending longitudinally from an end frame member 4 or 6 to central frame member 8 and placed between upright bar 76 and upper end 74 of frame member 4 (or upright bar 106 and upper end 104 in the case of second end frame 6).

Locking pins and other small hardware used to assemble scaffolding may be stored in parts box 80.

The transverse fork tubes 20 and 22 allow container 2 to be loaded by a forklift onto a truck bed from a side thereof.

Operation of the Invention

Invention 202 may be loaded with scaffold frames 5 and cross braces 15 such that up to ten scaffold frames 5 are stacked in leaning fashion against each side of upright frame 212 with the upper ends 17 and 19 of the legs 7, 9 of the first scaffold frame 15 resting against the rest plates 244, 246 of the upright frame 212. Once loaded with scaffold frames 5, a conventional strap may be used to secure the scaffold frames 5 to the upright frame 212, with selected opposing pairs of the attachment loops 274 of upper rails 240, 241 providing connection points for the connectors of the securing strap. A worker may step into invention 202 by standing on floor 262, securing the worker's safety harness lanyard to one of the lanyard rings 258. The worker may connect a safety chain between lanyard rings on the upright members 204, 205 of, for instance, first end 230 of invention 202. Thereafter, a lifting machine equipped with forks may be used to elevate the invention to the level of the next scaffolding to be added. Once the invention is raised to the level where new scaffolding is to be erected, the chain between the upright members 204, 205 is released, the securing strap around the leaning stack of scaffold frames 5 is removed, and the worker may remove the then outermost scaffold frame from the invention 202 and set it atop the existing scaffold structure. With two scaffold frames 5 set atop the scaffolding structure, a cross brace 15 may be removed from the L-shaped cradle brackets 248 and installed to interconnect the two scaffold frames then in place. Thereafter, the worker may move additional scaffold frames from the invention 202 to the places where needed in the scaffold structure. If the invention 202 is to be moved, the worker may again secure the remaining scaffold frames to the upright frame 212, step inside the invention 202, and connect a chain between upright posts 204, 205. Therefore the invention may be moved to a new location or elevation where additional scaffold frames and cross braces are required.

Once the supply of scaffold frames 5 in one side of the invention 202 is exhausted, the invention 202 may be lowered to the ground, and the lifting apparatus moved to the opposite end such that the end of the invention 202 still containing scaffold frames may be presented at the scaffold structure where additional scaffold frames are needed.

When a scaffold structure is to be disassembled, an empty or partially filled container invention 202 may be raised into position such that cross braces 15 may be loaded onto the L-shaped cradle brackets 248 and scaffold frames may be placed against the upright frame 212 with the legs of the innermost scaffold frame abutting the stop elements 314 within channels 234, 236.

Once the invention 202 is fully loaded with scaffold frames and cross braces, securing straps are applied to retain the scaffold frames and cross braces in their positions within the invention 202 and the loaded invention 202 may be loaded onto a trailer or truck bed and moved to a storage location until the scaffold frames and cross braces are again needed.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the container. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

Having described the invention, I claim:

1. A container for scaffold frames, the scaffold frames having upper ends and lower ends, the invention comprising a substantially horizontally disposed rectilinear base having four corners, an upright frame upstanding substantially midway along the base, the upright frame including upper corners having rest plates mounted thereto, an upstanding post mounted to the base at each corner thereof, at least one side rail interconnecting each upstanding post to the upright frame, the at least one side rail oriented generally parallel to the base, the base comprising a floor bordered on opposing sides thereof by elongate recessed channels, a pair of spaced apart stop elements disposed in each channel, each stop element spaced apart from an opposing side of the upright frame, a first pair of fork tubes extending substantially between opposing longitudinal ends of the base, a second pair of fork tubes fixed to the base and orthogonal to the first pair of fork tubes, the second pair of fork tubes extending substantially the width of the base, whereby scaffold frames may be placed in the container with each lower end thereof received within one of the channels and with the upper ends of the scaffold frames resting against the upright frame.

2. The container for scaffold frames of claim 1 wherein a kick plate is disposed between the floor and each channel, each kick plate mounted to and upstanding upon the base, each kick plate extending substantially the entire length of the channel.

3. The container for scaffold frames of claim 1 wherein a pair of spaced apart lift rings is disposed on each opposing end of the base.

4. A scaffold container for supporting a plurality of scaffold components including scaffold frames and cross braces, wherein the scaffold container comprises:

a base having an upright frame upstanding generally midway therealong, the base having corners, with an upright post mounted at each of the corners, the upright frame including spaced apart rest plates at an upper end thereof, substantially horizontal rails interconnecting sides of the upright frame with each of the corner posts, the base including a floor and leg receiving channels on opposing sides of the floor, each of the horizontal rails disposed approximately 36 inches to 60 inches above the floor of the base, the leg receiving channels having bottoms below the elevation of the floor, each leg receiving channel having a stop member therein spaced away from the upright frame, a kick plate separating the floor and each leg receiving channel, the upright frame, the posts, and the rails forming a rigid upstanding frame assembly with an open end at each end thereof for receiving scaffold frames in a generally upright orientation, lower ends of legs of the scaffold frames receivable within the recessed channels, a first pair of fork tubes extending substantially between opposing longitudinal ends of the base, a second pair of fork tubes fixed to the base and orthogonal to the first pair of fork tubes, the second pair of fork tubes extending substantially the width of the base, brace receiving brackets mounted to each of the posts and the sides of the upright frame, the brace receiving brackets extending outwardly from sides of the upstanding frame assembly.

5. The scaffold container of claim 4 wherein a lanyard ring is mounted along each post, whereby personal safety harness worn by a user may be attached to a one of the lanyard rings.

6. A transport and storage container for scaffold components, comprising:

a base supporting a substantially horizontally disposed floor thereon, an upright frame upstanding from the base, the upright frame including rest surfaces thereon, the floor bordered on opposing sides thereof by elongate recessed channels into which lower ends of scaffold frames may be received, the recessed channels having bottom walls lower than the floor, an upstanding elongate plate disposed between a side edge of the floor and at least one of the recessed channels, a stop element disposed in each channel, each stop element spaced apart a small distance from the upright frame, a first pair of fork tubes extending substantially between opposing longitudinal ends of the base, a second pair of fork tubes fixed to the base and orthogonal to the first pair of fork tubes, the second pair of fork tubes extending substantially the width of the base, whereby scaffold frames may be placed in the container with lower ends thereof resting upon the bottom walls of the channels and with upper ends of the scaffold frames resting against the upright frame.

7. The transport and storage container for scaffold components of claim 6 wherein at least two spaced apart upstanding posts are mounted to the base, the at least two spaced apart upstanding posts spaced away from the upright frame, at least one side rail joining each of the at least two spaced apart upstanding posts to the upright frame, the at least one side rail disposed generally parallel to the floor.

8. The transport and storage container for scaffold components of claim 7 wherein a second side rail interconnects each of the upstanding posts to the upright frame, the second side rail generally parallel with and disposed below the at least one side rail.

9. The transport and storage container for scaffold components of claim 6 wherein an upstanding elongate plate is disposed between each opposing side edge of the floor and each channel.

10. The transport and storage container for scaffold components of claim 7 wherein an attachment ring is fixed to each of the upstanding posts.

11. The transport and storage container for scaffold components of claim 6 wherein lift rings are provided on opposing sides of the base.

12. The transport and storage container for scaffold components of claim 6 wherein the upright frame is disposed substantially midway along the length of the base, the base having four corners, an upstanding post mounted at each corner of the base, at least one side rail joining each of the upstanding posts to the upright frame, the at least one side rail disposed generally parallel to the floor.

13. The transport and storage container for scaffold components of claim 7 wherein the upright frame has opposing sides defined by upstanding bar members, an L-shaped bracket extending horizontally from each of the upstanding bar members and from each of the upstanding posts, each L-shaped bracket having a horizontally disposed leg, each of the horizontally disposed legs of the L-shaped brackets disposed at generally the same height, whereby scaffold cross brace members may be carried upon the L-shaped brackets.

14. The transport and storage container for scaffold components of claim 7 wherein at least one loop is mounted to each of the at least one side rails, whereby a securing strap may be connected to the at least one loop of each of the at least one side rails.

15. A transport and storage container for scaffold components, comprising a base supporting a substantially horizontally disposed floor thereon, an upright frame upstanding from the base, the upright frame including rest surfaces thereon, the floor bordered on opposing sides thereof by elongate recessed channels into which lower ends of scaffold frames may be received, the recessed channels having bottom walls lower than the floor, an upstanding elongate plate disposed between a side edge of the floor and at least one of the recessed channels, a stop element disposed in each channel, each stop element spaced apart a small distance from the upright frame, the base is rectilinear, the upright frame is disposed substantially midway along the length of the base, the base having four corners, an upstanding post mounted at each corner of the base, at least one side rail joining each of the upstanding posts to the upright frame, the at least one side rail disposed generally parallel to the floor, the floor comprises a grating, each upstanding plate extending substantially the length of each channel, an attachment ring fixed to each of the upstanding posts, at least one loop is mounted to each of the at least one side rails, a first pair of fork tubes extending substantially between opposing longitudinal ends of the base, a second pair of fork tubes fixed to the base and orthogonal to the first pair of fork tubes, the second pair of fork tubes extending substantially the width of the base, a barrier element disposed at an outer end of each channel, at least one drain opening in the bottom wall of each channel, whereby scaffold frames may be placed in the container with lower ends thereof resting upon the bottom walls of the channels and with upper ends of the scaffold frames resting against the upright frame.

* * * * *